United States Patent [19]

Sherlock et al.

[11] 3,949,526

[45] Apr. 13, 1976

[54] DOOR CONSTRUCTION

[75] Inventors: Russell J. W. Sherlock; James Gordon Maynard, both of Toronto, Canada

[73] Assignee: H. A. Brown Limited, Markham, Canada

[22] Filed: July 31, 1974

[21] Appl. No.: 493,409

[52] U.S. Cl. ..... 49/501; 52/616

[51] Int. Cl.[2] ..... E06B 3/16

[58] Field of Search ..... 49/501, 503, 506; 52/615, 52/616, 623, 627, 613, 614, 628

[56] References Cited

UNITED STATES PATENTS

| | | | |
|---|---|---|---|
| 2,703,159 | 3/1955 | Van Fleet | 52/627 |
| 3,075,255 | 1/1963 | Taubman | 49/411 |
| 3,334,464 | 8/1967 | Charles | 49/501 X |
| 3,348,337 | 10/1967 | Grasso | 49/503 X |
| 3,473,988 | 10/1969 | Rullier et al. | 52/616 X |
| 3,673,735 | 7/1972 | Winsler et al. | 49/501 X |
| 3,802,127 | 4/1974 | Silvernail | 49/501 X |
| 3,834,101 | 9/1974 | Wilder et al. | 52/627 X |

*Primary Examiner*—Philip C. Kannan

*Attorney, Agent, or Firm*—Fetherstonhaugh & Co.

[57] ABSTRACT

An insulated panel such as a door panel assembly comprising a frame which consists of a plurality of hollow plastic moulded elements having a panel mounted in the frame. The elements of the frame are secured with respect to one another by a body of foamed plastic material which fills the hollow chambers which are formed in the plastic moulding elements and extends continuously between the abutting ends of the plastic moulding elements.

10 Claims, 4 Drawing Figures

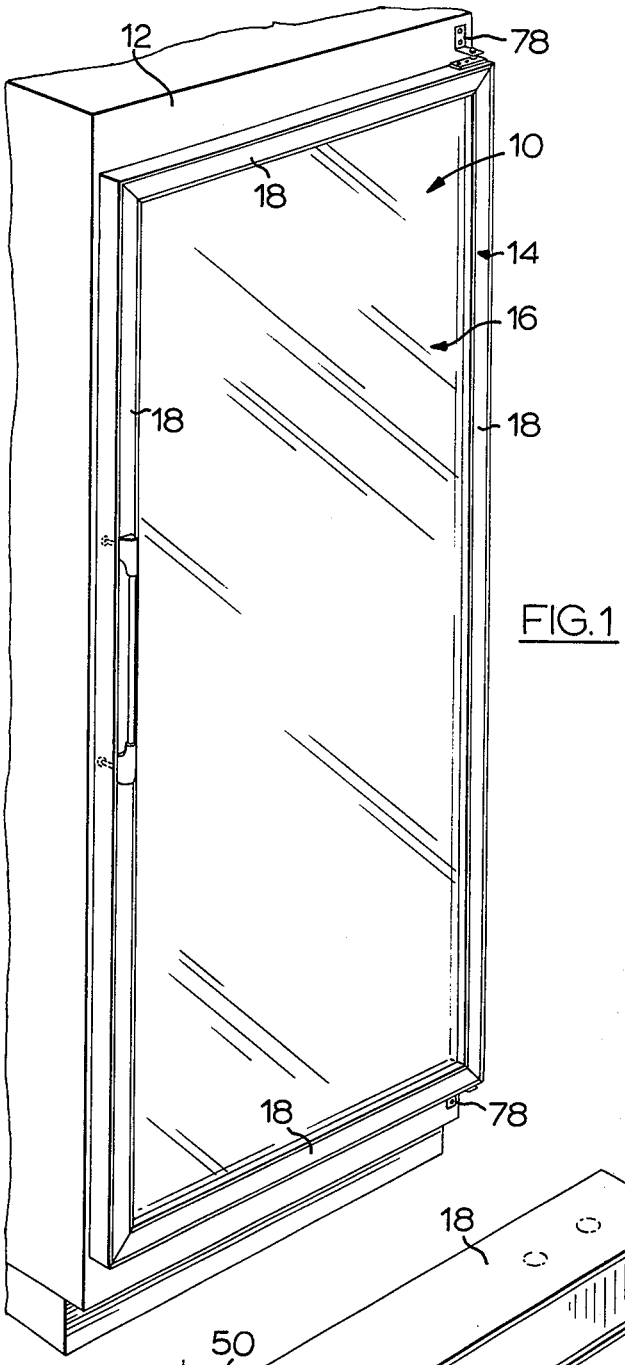
FIG. 1
FIG. 3
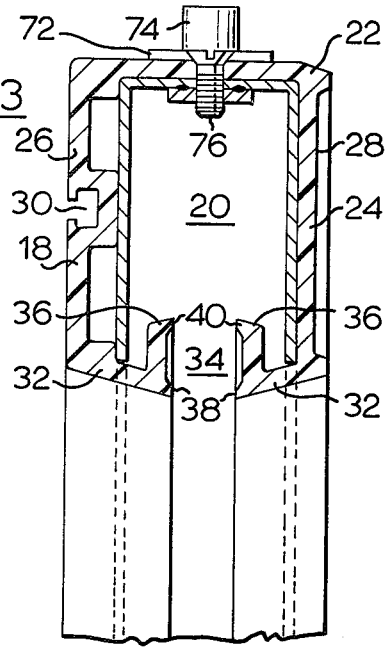
FIG. 2
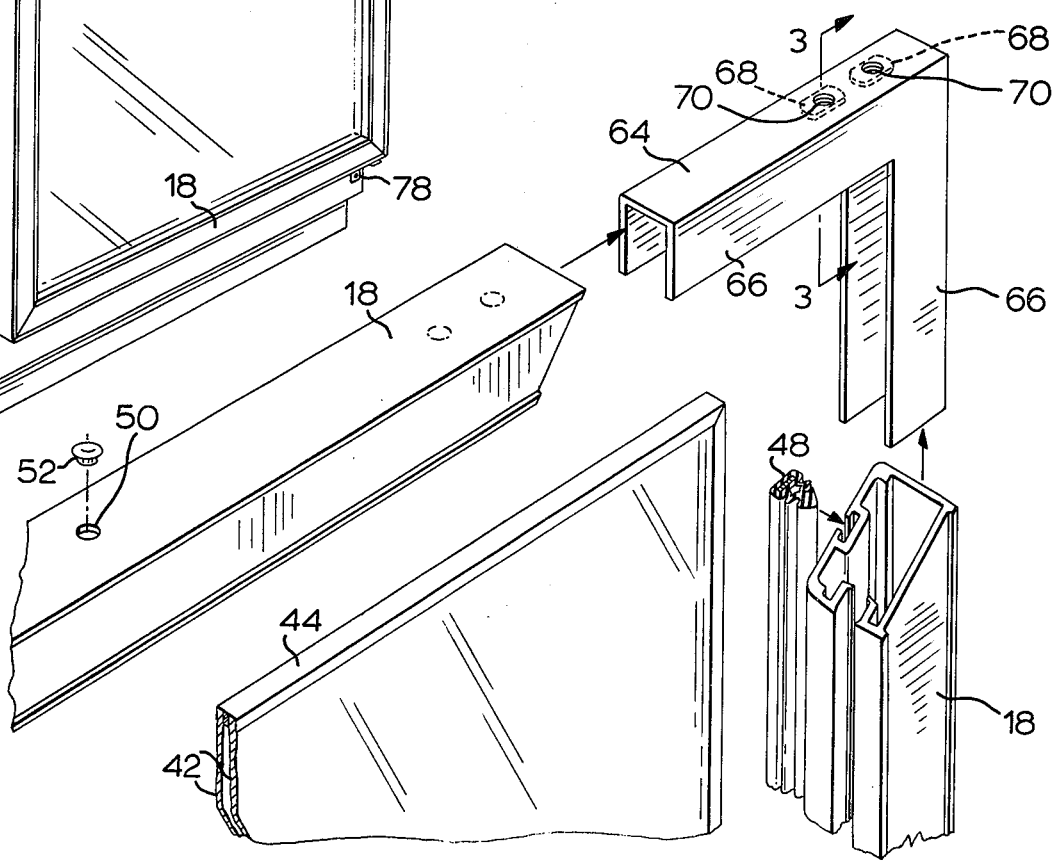

DOOR CONSTRUCTION

FIELD OF INVENTION

This invention relates to insulated door assemblies and their method of manufacture. In particular, this invention relates to an insulated door assembly wherein a door panel is mounted within a frame by means of a body of foamed plastic material located within the chamber formed within the frame.

PRIOR ART

Considerable difficulty has been experienced in attempting to construct an insulated door assembly in which the various components are secured to one another without the use of fastening elements which lack the insulating character of the remainder of the assembly. When metal fastening elements are used to secure a door frame to a door panel, such as a glass door panel, the metal element acts as a conductor and reduces the efficiency of the insulating door. Furthermore, if the metal fastening elements are exposed at the outer or inner surfaces of the door, frosting can occur.

In the larger door construction presently used for refrigerator merchandise display cabinets, it is not possible to make the frame from a material other than metal because the door assembly has relied for its strength on the strength of the frame and the structure used to connect the ends of the frame members. Considerable difficulty has been experienced in attempting to provide an effective connection between the ends of the frame members. The ends of the frame members are generally held together by means of an angle bracket which is secured by means of set screws or the like to adjacent ends of the frame member. This structure is costly to produce and contributes substantial cost to the cost of assembling the doors.

Summary

The present invention overcomes the difficulties of the prior art described above and provides an insulated panel assembly which is easy to assemble and which is inexpensive to manufacture.

According to an embodiment of the present invention, an insulated panel assembly comprises a frame consisting of a plurality of hollow plastic moulding elements, a panel mounted in the frame and a body of foamed plastic material filling hollow chambers formed within the plastic molding elements and extending continuously between the abutting ends of the plastic molding elements to secure the plastic molding elements with respect to one another in the required frame configuration with the panel mounted therein.

According to a further embodiment of the present invention a method of manufacturing a door assembly of the type described above wherein each marginal edge portion of the panel is located within a longitudinal passage formed in the molding element with the ends of each adjacent molding element abutting one another such that the chambers formed in the abutting elements open into one another, restraining the walls of each molding element against movement in a direction away from the panel and filling the chamber with fluid plastic foam such that the foamed plastic material extends continuously between abutting ends of adjacent molding elements and secures the molding elements with respect to one another in a frame configuration about the panel.

PREFERRED EMBODIMENT

The invention will be more clearly understood after reference to the following detailed specification read in conjunction with the drawings wherein:

FIG. 1 is a pictorial view of the front of a refrigerator display cabinet illustrating a door panel assembly according to an embodiment of the present invention;

FIG. 2 is an exploded view of a corner of a door;

FIG. 3 is a sectional view of an assembled door taken along the line 3—3 of FIG. 2.

Figure 4:
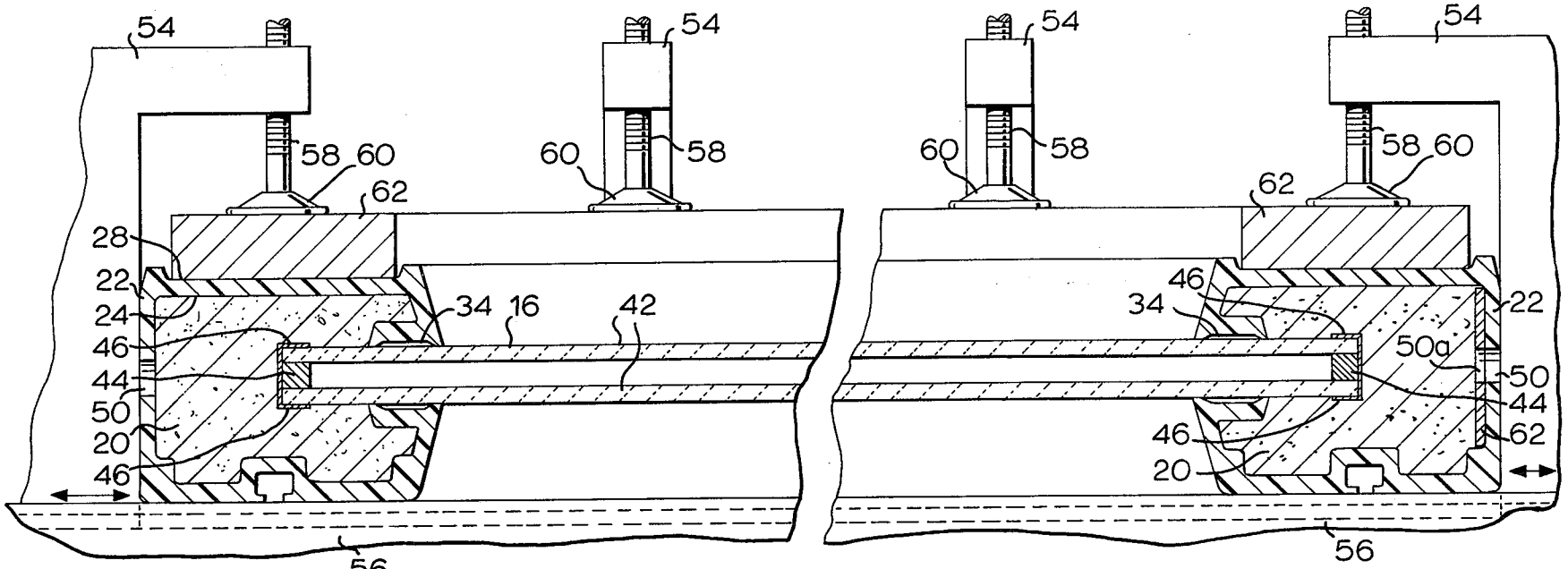
FIG. 4 is an end view diagrammatically illustrating the apparatus used for assembling a door.

With reference to the drawings, the reference numeral 10 refers generally to a door panel assembly according to an embodiment of the present invention mounted on a refrigerator display cabinet 12. The door panel assembly 10 consists of a frame 14 and a door panel 16. The frame 14 consists of four hollow plastic molding elements 18, the ends of which are mitered so that the chamber 20 formed with each element 18 opens into the adjacent chamber of the element to which its end is abutted. As shown in FIG. 2 of the drawings, each of the extruded plastic molding elements has an outer wall 22 and a pair of oppositely disposed side walls 24 and 26. The outer side wall has a shallow recess 28 extending longitudinally thereof and the inner wall 26 has a T-shaped slot 30 extending longitudinally thereof. The element 18 also has a pair of walls 32 projecting inwardly from the side walls. The walls 32 are spaced from one another at their inner edges to provide a longitudinally extending passage 34 therebetween. Each of the walls 32 also has a lug portion 36 projecting from the inner edge thereof inwardly of the chamber 20. The walls 34 have a lip portion 38 at the inner end thereof which bears against the surface of the door panel 16 and prevents contaminants such as water and dirt from entering the chamber 20. The ridges 40 at the inner ends of the lugs 36 serve to prevent leakage of foam from the chamber 20 during the foaming operation as will be described hereinafter. The expanding foam acts on the outer surface of the lugs 36 and presses the ridges 40 into engagement with the door panel to seal the moldings with respect to the door panel.

The hollow plastic molding elements are preferably made from an extruded plastic material such as PVC, ABS or the like.

The door panel 16 is in the form of a double-glazed window consisting of a pair of glass panels 42 secured in a spaced relationship by means of an edge mounting element 44 which, as shown in FIG. 4 of the drawing, includes a pair of side wall elements 46 which project outwardly from the outer faces of the glass panels 42. The door panel is of a type which is presently commercially available and widely used in refrigerator display cabinet door assemblies. A bumper seal member 48 of conventional construction is mounted in the T-shaped slot 30 which extends about the inner wall 26 of the frame so as to be disposed between the frame 14 and the outer wall of the cabinet 12 to effectively seal the opening in the front of the cabinet 12 when the door 10 is closed.

A foam filling passage 50 is formed in the end wall 22 of at least two of the plastic molding elements 18 and opens into the chamber 20 thereof. A plug 52 is adapted to be inserted into the opening 50 after the foamable plastic material has been inserted therin in use as will be described hereinafter.

FIG. 4 illustrates an apparatus suitable for use in the assembly of the door. The apparatus consists of a plurality of brackets 54 which are slidably mounted on a base 56 and have a clamping screw 58 threadably mounted therein. A plurality of clamping brackets 54 with their associated clamping screws 58 are mounted on the base 56 at spaced intervals about the entire periphery of the configuration of the door which is to be assembled. It has been found that the clamping brackets 54 may be spaced at longitudinal intervals measuring about six inches about the periphery of the door being assembled. Each of the clamping screws 58 has a head portion 60 at the lower end thereof and a suitable adjustment bar (not shown) at the upper end of the jacking screw 58 for rotatably driving the jacking screw 58 with respect to the bracket 54. The brackets 54 are slidably mounted with respect to the base 56 so as to be movable towards and away from one another to receive and release an assembled door unit therefrom. T-slots may be formed in the base 56 to permit the brackets to slide with respect to the base 56.

In order to manufacture a door, an extruded plastic molding of the type previously described is cut to provide four lengths each having angularly inclined end faces. The marginal edges of the door panel 16 are thoroughly cleaned and a molding element 18 is mounted at each edge of the door panel 16 with marginal edge portions of the door panel 16 projecting into the chamber 20 of each molding by way of the longitudinal passage 34. The angularly inclined end faces of the molding elements 18 abut one another so that the chambers 20 formed between adjacent elements 18 open into one another. The partially assembled door is then located on the base 56 as shown in FIG. 4 of the drawings. Spacer bars 62 are then placed on the surface of the outer wall 24 within the channel 28 formed therein. The blocks 62 may be in separate lengths or they may be assembled in the form of a frame having the same general proportions as that of the door frame. The clamping screws 58 are tightened downwardly so that the pressure pad 60 pressed downwardly on the spacer blocks 62 which in turn press downwardly on the outer wall 24. It is not necessary to apply any great pressure to the outer wall 24 by means of the clamping screws 58 as the primary function of the clamping mechanism is to prevent outward bulging of the wall 24 during the expansion of the foam plastic during the molding operation. The vertical post of the mounting bracket 54 bears against the outer surface of the wall 22 and serves to restrain the wall 22 against outward bulging during the molding operation. Foamable plastic material in fluid form is then injected through the passages 50 into the chamber 20 and extends around the chamber 20 until the complete chamber 20 is filled with foamed plastic material over the full length thereof. It will be noted that the passages 50 are located a substantial distance from the frame corners so that the foamed plastic material will extend in a continuous body around each corner. The charge of foam is applied at each passage 50 such that the two expanding bodies of foam do not meet one another at a corner so that any possibility that the two bodies of foam are not rigidly connected to one another will not serve to weaken the frame at the corners thereof. It has been found that a self-supporting insulating door assembly may be formed without the aid of any additional securing structure other than the body of foamed plastic material.

In applications where the door is of a substantial length or width, the plastic molding elements 18 may be reinforced by locating a flat metal strap 62 within the chamber 20 and extending in a face-to-face relationship with respect to the wall 22 or a wall 24. The strap 62 will be formed with a passageway **50*a* in order to admit the foamed plastic to the chamber 20.**

If the door is heavy and is hingedly mounted, a hinge plate in the form of a U-shaped channel bracket 64 may be inserted within the adjacent ends of the elements 18. The bracket 64 has arms 66 which project within the open ends of the elements 18. One of the arms 66 has a pair of threaded nuts 68 mounted on the inner face thereof in alignment with passages 70 which open through the arm 66. A hinge plate 72 having a hinge pin 74 projecting upwardly thereof is secured to the element 18 by means of countersunk screws 76. The hinge pin 74 projects outwardly from the door and is pivotally received in hinge plates 78 carried by the cabinet 12. It will be noted that only one arm 66 of the bracket 64 is secured with respect to an extruded plastic element 18. It has been found that the foam plastic material which is located within the element 18 which receives the other arm 66 of the bracket serves to adequately secure the elements 18 with respect to one another without requiring any additional fasteners. It will be noted that there is no direct connection between the glass and the metal corner bracket 64.

The foamed plastic material may be in the form of a rigid foam such as rigid polyurethane foam. The foam may be introduced into the cavity 20 in a pre-mixed form including the foam and a foaming agent by means of an apparatus such as the Universal Mark 19A (trade mark) rigid foam machine available from Viking Engineering Co. Ltd.

When metal inserts are included in the structure, the metal inserts are preferably "set".

From the foregoing it will be apparent that the basic door assembly of the present invention provides a structure wherein the frame is locked to the door panel by means of the foamed plastic material which fills the cavity formed in the extruded plastic moldings. The door derives a substantial portion of its strength from the strength of the foamed plastic body. The insulating efficiency of the door is enhanced by the properties of the urethane foam. Furthermore, the fact that the urethane foam will not absorb or be mechanically affected by water, the structure of the door will not deteriorate as a result of coming into contact with condensation of humidity. Furthermore, the urethane foam acts as a shock absorber in the assembly so that if the door is slammed heavily, the urethane foam will absorb the impact and prevent damage to the window.

These and other advantages of the structure of the present invention will be apparent to those skilled in the art.

Various modifications of the present invention will be apparent to those skilled in the art. For example, in order to achieve complete sealing of the plastic extrusion with respect to the glass frame, a soft polyvinylchloride tape may be applied about the marginal edges of the glass before the plastic extrusion is mounted thereon so that the soft PVC tape is disposed between the glass and the raised edges 34 and 40 of the plastic molding elements.

Panel may be glass, plastic or metal etc, and may be used in building construction.

These and other modifications of the present invention will be apparent to those skilled in the art.

We claim:

1. An insulated panel assembly comprising a. a frame consisting of a plurality of hollow plastic molding elements having a longitudinally extending chamber formed therein which is open at either end, said elements being arranged in an end to end abutting relationship with the chambers thereof opening into one another at said abutting ends, and passage means extending longitudinally of one side of each of said plastic molding elements and opening outwardly from said chamber, b. panel means mounted in said frame and having marginal edge portions extending through said passage means of said molding elements into said chambers, and c. a body of foamed plastic material filling said chambers and extending continuously between abutting ends of said molding elements to secure said elements with respect to one another in the required frame configuration with said panel means mounted therein, d. said plastic molding elements each having a pair of side edges disposed one on either side of said longitudinal passage, and flange means projecting inwardly of said chamber from each of said side edges and engaging opposite faces of said marginal portion of said panel, said flange means being urged towards said panel by said body of foamed plastic material to lock said panel therein.

2. An insulated door panel assembly as claimed in claim 1 wherein each of said molding elements has locking lug means projecting inwardly of said chamber on opposite sides of said passage means, said locking lug means being embedded in said foamed plastic body and formed to prevent withdrawal therefrom in a direction away from the plane of said door panel means.

3. An insulated assembly as claimed in claim 1 wherein said door panel means has enlarged peripheral edges serving to secure said panel within said body of foamed plastic material.

4. An insulated panel as claimed in claim 1 including a reinforcing metal strap disposed within said chamber and extending longitudinally of at least one inner face of said plastic molding elements to rigidify said frame.

5. An insulated panel assembly as claimed in claim 1 wherein said panel is a double-glazed transparent glass panel.

6. An insulated panel assembly as claimed in claim 1 including foam input passage means opening inwardly of at least two of said plastic molding members and plug means closing said foam input passage means.

7. An insulated panel assembly as claimed in claim 1 including hinge mounting plate means disposed within said chamber at at least two adjacent corners thereof whereby said assembly may be hingedly mounted as a door panel assembly.

8. An insulated door assembly as claimed in claim 5 wherein said hinge mounting plate means includes a corner piece comprising a pair of arms connected at their inner ends and arranged with one arm extending inwardly of each chamber of the pair of abutting ends of said plastic moldings at said corner of the frame.

9. An insulated door panel as claimed in claim 8 including means for securing at least one arm of said corner piece with respect to its adjacent molding element.

10. An insulated door assembly as claimed in claim 9 wherein each of said arms of said corner piece is U-shaped in cross-section.

* * * * *